US005490366A

United States Patent [19]

Burns et al.

[11] Patent Number: 5,490,366

[45] Date of Patent: Feb. 13, 1996

[54] ADJUSTABLE WALL TIE

[76] Inventors: William S. Burns, 12 Bristol Sands Crescent, Stouffville, Ontario, Canada, L4A 7X4; Patrick J. Sweeney, 4 Chadbury Place, Agincourt, Ontario, Canada

[21] Appl. No.: 364,344

[22] Filed: Dec. 27, 1994

[30] Foreign Application Priority Data

Nov. 24, 1994 [CA] Canada ..... 2136700

[51] Int. Cl.[6] ..... E04B 2/30; E04B 2/44

[52] U.S. Cl. ..... 52/713; 52/565; 52/568; 52/379; 52/383

[58] Field of Search ..... 52/712, 713, 565, 52/568, 379, 383

[56] References Cited

U.S. PATENT DOCUMENTS

| | | | |
|---|---|---|---|
| Re. 16,572 | 3/1927 | White . | |
| 779,268 | 1/1905 | Elliott . | |
| 1,304,651 | 5/1919 | Bodine . | |
| 1,621,478 | 3/1927 | White . | |
| 1,946,732 | 2/1934 | Danielson . | |
| 3,277,626 | 10/1966 | Brynjolfsson et al. | 52/713 |
| 3,377,764 | 4/1968 | Storch | 52/713 |
| 3,729,882 | 5/1973 | Allen . | |
| 3,964,226 | 6/1976 | Hala et al. | 52/713 X |
| 3,964,227 | 6/1976 | Hala | 52/713 X |
| 4,765,115 | 8/1988 | Pollina . | |
| 4,827,684 | 5/1989 | Allan . | |
| 4,852,320 | 8/1989 | Ballantyne . | |

*Primary Examiner*—Carl D. Friedman
*Assistant Examiner*—Christopher Todd Kent
*Attorney, Agent, or Firm*—Arne I. Fors; Jeffrey T. Imai; D. Doak Horne

[57] ABSTRACT

An adjustable wall tie for anchoring and tying a masonry veneer to a structural masonry wall having a combination of component parts which includes a tension anchor element disposed in a mortar joint of a structural masonry block wall interconnected with an adjustable double-end hook secured at both ends in adjacent horizontal mortar joints of courses of a masonry veneer wall.

4 Claims, 4 Drawing Sheets

ADJUSTABLE WALL TIE

BACKGROUND OF THE INVENTION

This invention relates to an anchoring and tying device and, more particularly, relates to an anchoring and vertically adjustable double-end hook tie device for securing together spaced wythes such as a masonry veneer wall to a structural masonry wall of block like construction.

Common residential and commercial building construction practice entails forming a brick or other masonry veneer wall adjacent a structural inner supporting wall. Generally the masonry veneer is spaced apart from the structural inner wall in a construction technique known as cavity wall construction. The air gap deters the formation and build up of damaging moisture on the structural inner wall as well as providing some thermal and acoustic insulation.

Anchors or ties are required to span the air gap at predetermined locations to secure the masonry veneer to the inner structural wall. Anchors are often formed integral with the structural wall where said structural wall is of masonry block construction. Vertically adjustable ties are required where the mortar joints of the veneer wall do not align with the the mortar joints of the structural block wall.

In the prior art it is known to use metallic elements for affixing masonry veneers to inner structural walls. U.S. Pat. No. 779,268 issued Jan. 3, 1905 discloses a combination of anchoring and tying components for use with block like members having grooves in their meeting edges. Right angled or 'T' shaped flanges formed in the anchor and tie members engage grooves in mating blocks to fixedly attach a facing wall to the support wall. This disclosure provides little vertical adjustment of the ties and is not suitable for standard bricks and blocks.

U.S. Pat. No. 1,946,732 issued Feb. 13, 1934 discloses a device for securing masonry veneer walls to structural masonry support walls. A single vertical rod is disposed on the outer face of a support wall block by means of right angularly extended end portions embedded in the mortar joints over and under said block. A bonding member attached to the vertical rod is embedded in a mortar joint of the masonry veneer. In this disclosure the vertical rod, having a length substantially the same as the relatively large standard construction block, provides ample vertical adjustment but may provide inadequate horizontal support if the bonding member is placed in the central region of the vertical rod.

In U.S. Pat. No. 3,277,626 issued Oct. 11, 1966 a double shank adjustable wall tie is disclosed for tying together spaced wythes consisting of a structural wall and a veneer wall. A planar "U" shaped anchor having loops formed in the free ends is disposed in the horizontal mortar joint of the structural wall with said loops extending outward. A tie member secured in a mortar joint of the veneer wall has a base piece and a pair of outwardly extending generally parallel arms, each of said arms having a transversely turned finger at the free end thereof. Said fingers are adapted to engage the loops of the anchor member for securement of the veneer wall to the structural wall. Limited vertical adjustment is provided wherein the bond strength is decreased as engagement of the fingers in the loops decreases. For a commercially available anchor and tie device similar in principle and application to this disclosure it is recommended that vertical adjustment not exceed 1½" from the tension tie anchor to avoid possible failure by bending.

It is a principal object of the present invention to provide a new and improved anchoring and tying device for securing a masonry veneer wall to a solid masonry brick or block wall.

A further object of the present invention is to provide a new and improved anchoring and tying device which may be used in residential or commercial construction employing standard masonry bricks and blocks or the like.

It is still a further object of the present invention to provide ample vertical adjustment of the tie member without compromising the lateral strength of the device.

SUMMARY OF THE INVENTION

In its broad aspect, an adjustable wall tie of the present invention for securing spaced wythes together, each formed of courses of preformed block or brick having cementing means for joining the courses together and defining a space therebetween, comprises a rectangular tension anchor having a base member and a pair of substantially parallel longitudinal side members extending from said base member perpendicular thereto, a transverse end member parallel to the base member joining the distal ends of the side members together, and an intermediate transverse member attached to the side members in proximity to said end member forming an elongated transverse slot therebetween, said tension anchor being adapted to be positioned whereby the base member can be cemented in one of said wythes with the opposite end member with transvere slot disposed in the space between the wythes; and a generally U-shaped double-ended hook having laterally spaced longitudinal side sections each comprised of vertically spaced upper and lower longitudinal members and vertical members joining said upper and lower members together at one end defining a web, transverse base members joining the upper members together and the lower members together at the opposite end to form a planar upper extension opposing and parallel to a planar lower extension joined by and extending from said web, the planar upper extension and the planar lower extension being adapted and positioned whereby the base members may be positioned in and cemented in the other of the said wythes with the web disposed in the space between the wythes and extending through the slot of the tension anchor for tying said wythes together.

BRIEF DESCRIPTION OF THE DRAWINGS

The double ended hook tie of the present invention will now be described with reference to the accompanying drawings, in which.

DESCRIPTION OF THE PREFERRED EMBODIMENTS

Figure 1:
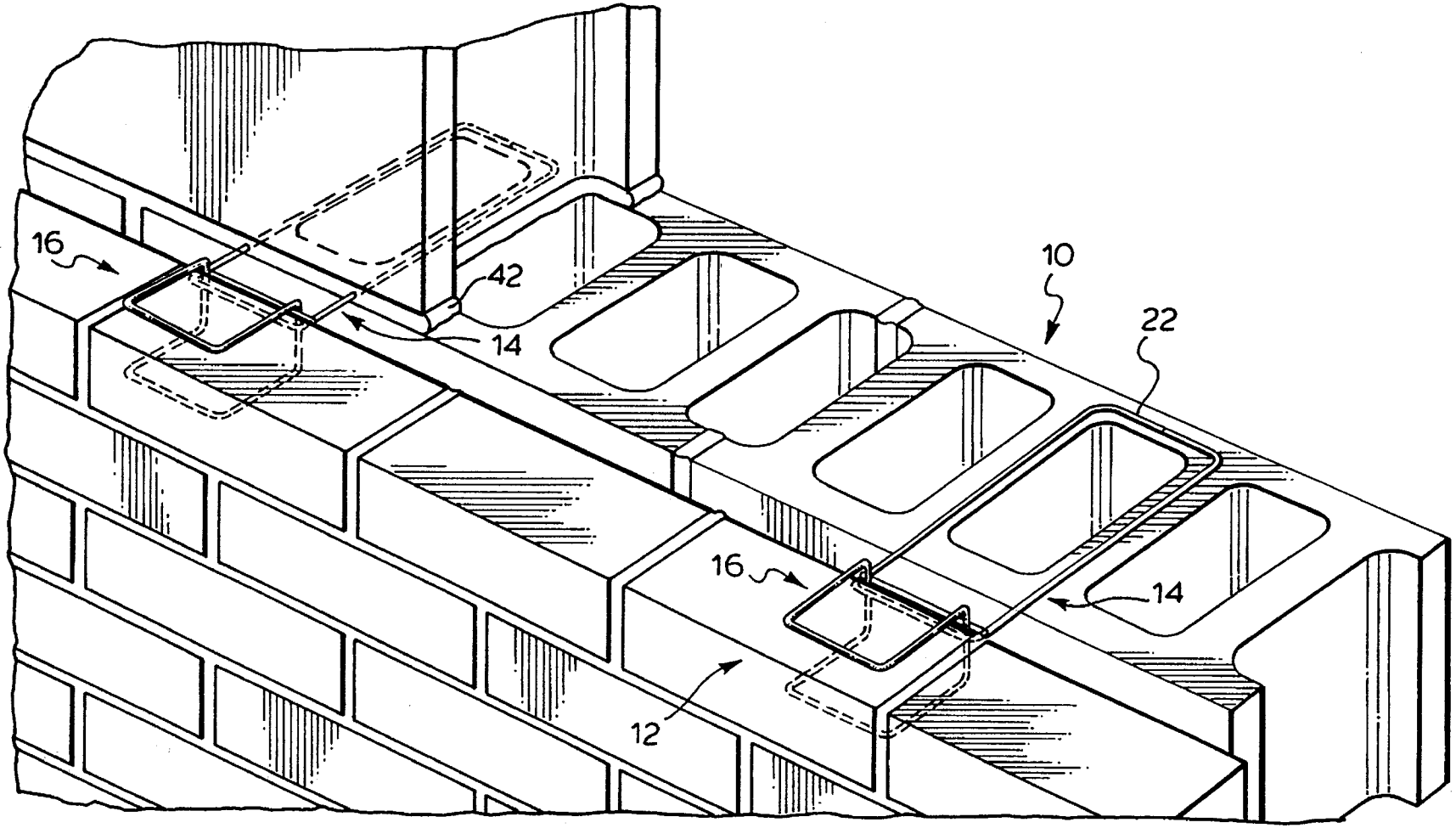
FIG. 1 is a perspective view of a typical veneer wall construction employing an embodiment of the hook tie of the invention embedded in the mortar joints.
Figure 2:
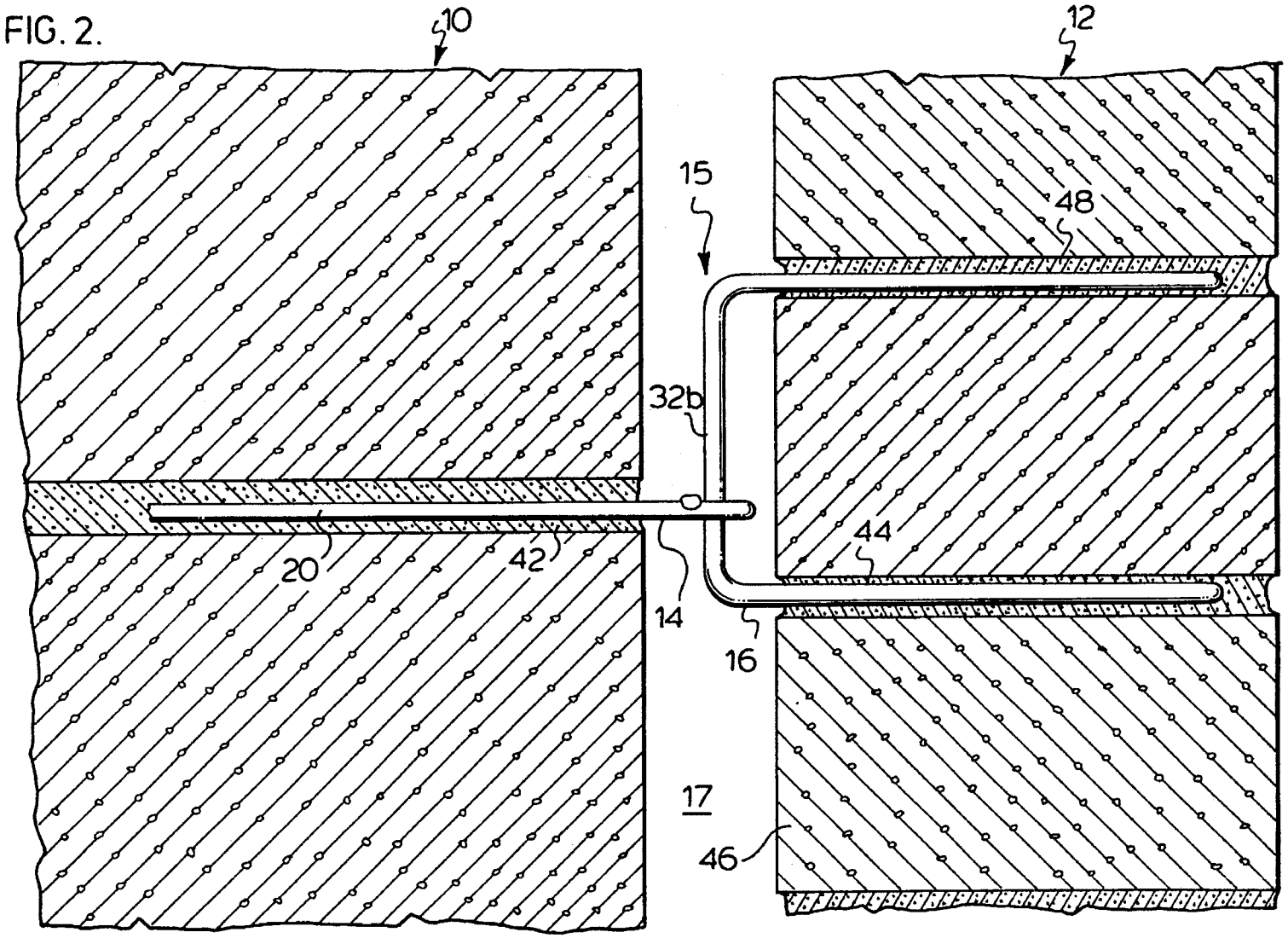
FIG. 2 is a side elevation, partly in section, of the hook tie shown in FIG. 1.

With reference to FIGS. 1 and 2 there is shown a typical residential or commercial masonry wall comprising a pair of wythes consisting of a structural block wall 10 and a substantially parallel brick veneer wall 12, spaced laterally therefrom. A tension anchor 14, interconnected with a double-ended hook 16, forms a wall tie 15 which spans the air gap 17 to secure said brick veneer wall 12 to the structural block wall 10.

Figure 3:
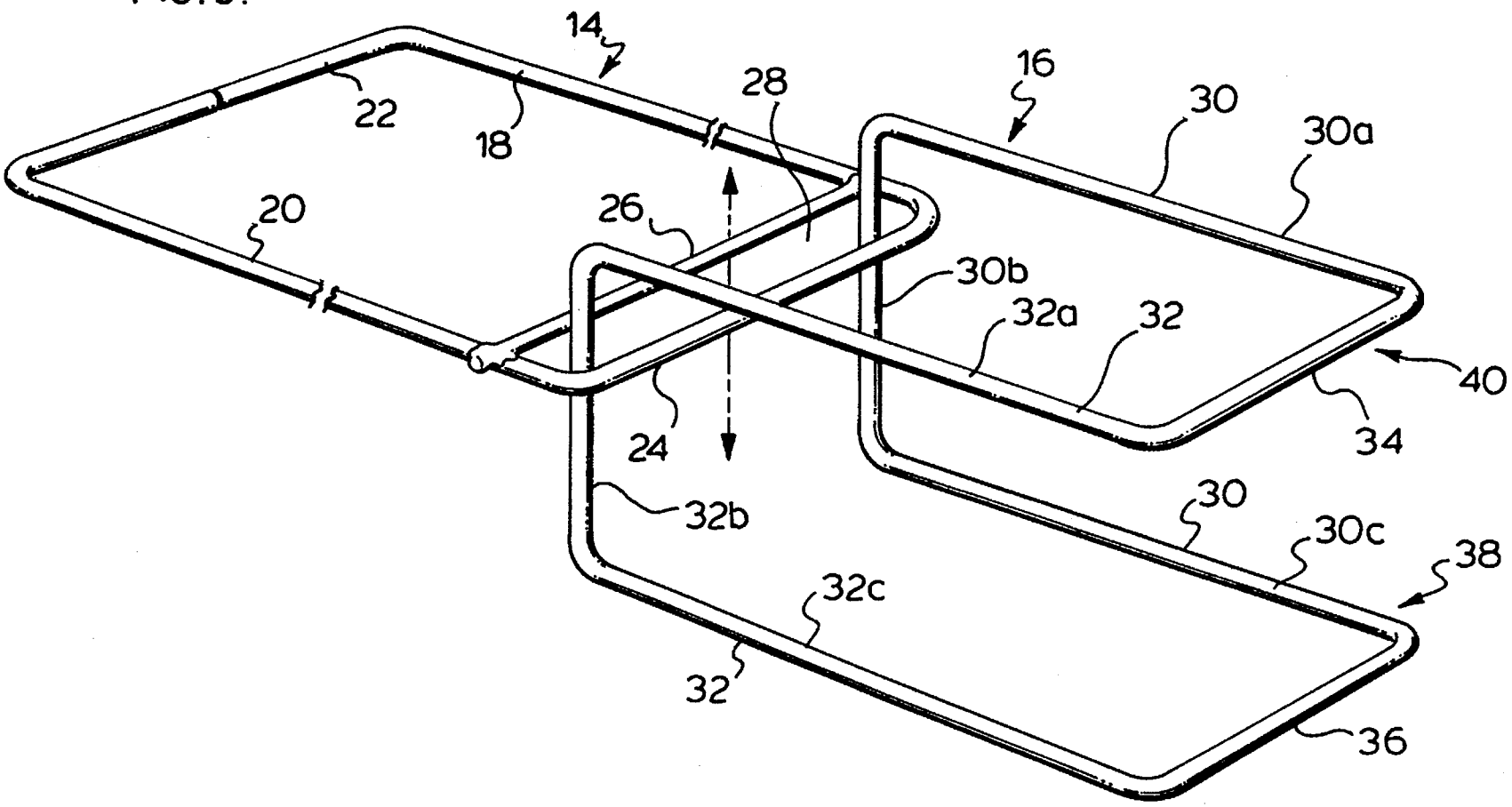
FIG. 3 is a perspective view of the anchor and tie components of the said hook tie in engagement according to the present invention.

Referring now to FIG. 3 of the drawings, the tension anchor 14 and double-end hook 16 of the present invention are shown. The tension anchor is a generally rectangular member of heavy wire stock metal having a pair of substantially parallel longitudinal members 18 and 20, connected at opposing ends thereof by substantially parallel end cross members 22 and 24. An intermediate cross member 26 is fixedly attached to opposing longitudinal members 18 and 20 in close proximity and substantially parallel to cross member 24 forming an elongated opening or slot 28 therein. The longitudinal side members 18, 20 are substantially coplanar and substantially planar and perpendicular with the cross end members 22, 24 and 26.

The double-end hook 16 of the present invention comprises a generally rectangular, U-shaped closed loop of heavy wire stock metal having longitudinal side sections 30 and 32 joined by transverse base legs 34 and 36. The longitudinal side sections 30 and 32 are bent at right angles at an upper position and a lower position to form upper horizontal legs 30*a* and 32*a*, vertical legs 30*b* and 32*b* and lower horizontal legs 30*c* and 32*c*. Lower legs 30*c* and 32*c* and transverse base leg 36 form a planar lower extension 38, perpendicular to the planar web 37 formed by vertical legs 30*b* and 30*b*. Upper legs 30*a* and 32*a* and transverse base leg 34 form a planar upper extension 40 opposing and parallel to the lower extension 38. Vertical legs 30*b* and 32*b* are provided with a length to allow the upper extension 40 and lower extension 38 to engage the upper and lower faces respectively of a standard brick. The invention may be applied to a masonry veneer of any reasonable dimension by adapting the length of the vertical legs 30*b* and 32*b* accordingly.

Transverse base members 34 and 36 defining the width of web 37 are of a length slightly less than the length of the elongated slot 28 of the tension anchor 14 to allow insertion of the double-end hook 16 through said elongated slot 28.

Referring again to FIGS. 1 and 2, in the fabrication of masonry walls wherein the adjustable wall ties of the present invention are employed, tension anchors 14 are embedded in horizontal mortar joints 42 of the structural wall 10 during erection. Longitudinal members 18 and 20 of the tension anchor 14 extend outward into the air gap 17, so as to expose the elongated slot 28 for engagement of the web 37 of the double-end hook 16 therein. Spacing of said tension anchors 14 is determined by building code specifications or other building requirements. Vertical spacing for standard brick veneer construction can range from. 2 ¼" to 16" in height.

As the brick veneer wall is erected, double-end hooks ties 16 are inserted through the elongated slots 28 of embedded tension anchor ties 14. The lower extension 38 of the double-end hook tie 16 is embedded in a horizontal mortar joint 44 on the lower side of a course of bricks 46 while the upper extension 40 is embedded in the mortar joint 48 above said course of bricks 46. The vertical members 30*b* and 32*b* forming web 37 are slidingly disposed in slot 28 to tie the wythes together as a unit.

Figure 4:
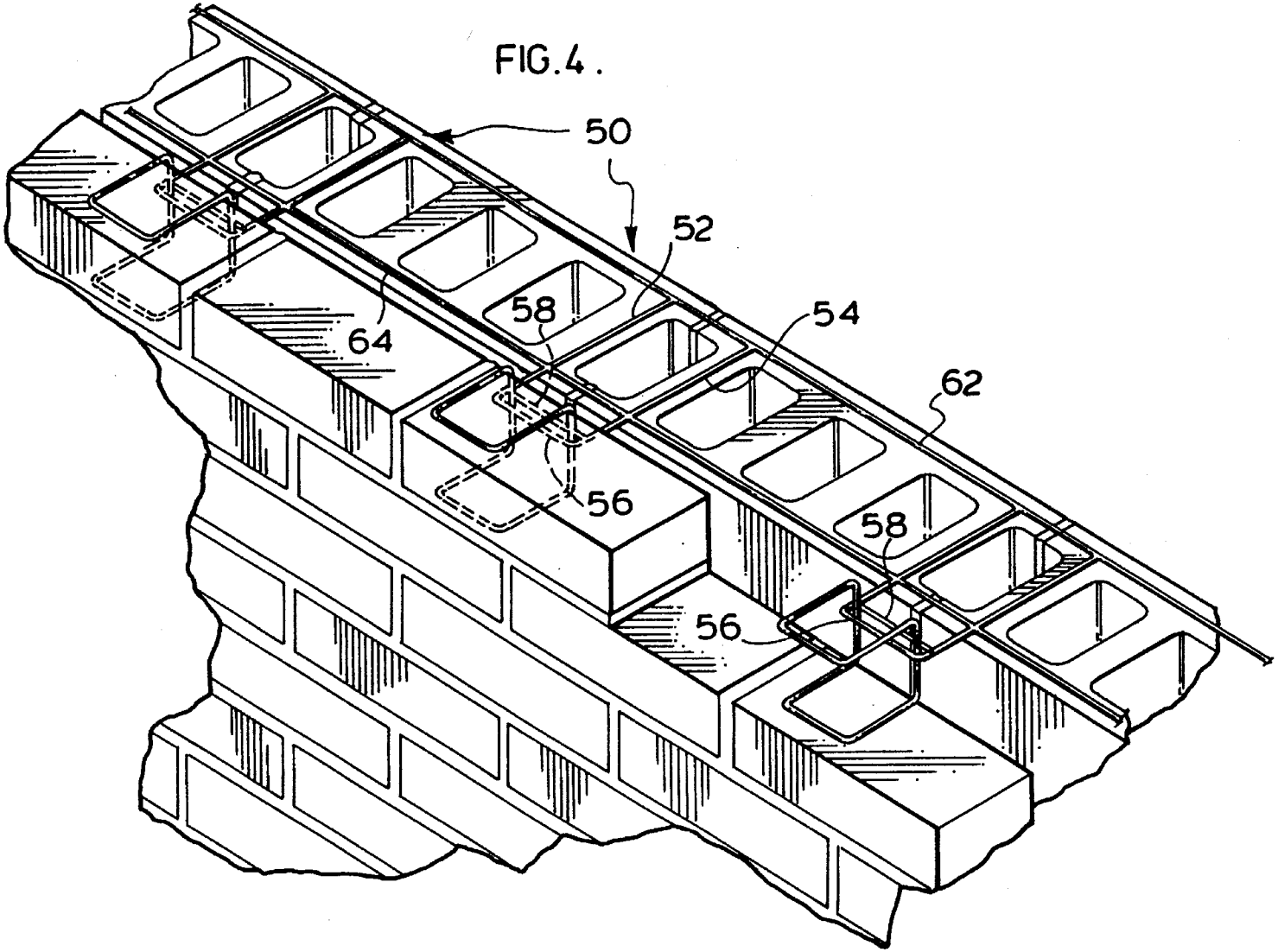
FIG. 4 is a perspective view of a further embodiment of the hook tie of the invention.

FIG. 4 illustrates another embodiment of the invention in which each tension anchor 50 comprises longitudinal side members 52 and 54 connected at one end by end members 56 and spaced parallel intermediate cross member 58 to define a slot therebetween and connected at the opposite end by elongated base wire 62. An elongated second wire 64 parallel to and spaced from wire 62 may be connected to side members 52 and 54, base wire 62 and intermediate wire 64 uniformly spacing a plurality of anchors 50 from each other for ease of installation.

The adjustable wall tie of the present invention provides advantages over the prior art. The double-end hook is simple to manufacture and easy to install. Vertical adjustment of the double-end hook is only limited by the length of the web since both ends of the hook are embedded in the mortar and the likelihood of failure by bending is avoided or at least reduced.

It will be understood, of course, that modifications can be made in the embodiment of the invention illustrated and described herein without departing from the scope and purview of the invention as defined in the appended claims.

We claim:

1. An adjustable wall tie for securing spaced wythes each formed of courses of preformed block or brick, having cementing means for joining the courses together, said wythes defining a space therebetween, said wall tie comprising: a rectangular tension anchor having a base member and a pair of substantially parallel longitudinal side members extending from said base member perpendicular thereto, a transverse end member parallel to the base member joining the distal ends of the side members together, and an intermediate transverse member attached to the side members in proximity to said end member forming an elongated transverse slot therebetween, said tension anchor being adapted to be positioned whereby the base member can be cemented in one of said wythes with the opposite end member with the transverse slot disposed in the space between the wythes; a generally U-shaped double-ended hook having laterally spaced longitudinal side sections each comprised of vertically spaced upper and lower longitudinal members and vertical members joining said upper and lower members together at one end defining a web, and transverse base members joining the upper members together and the lower members together at an end opposite said one end to form a planar upper extension opposing and parallel to a planar lower extension joined by and extending from said web, the planar upper extension and the planar lower extension being adapted and positioned whereby the base members may be positioned in and cemented in the other of the said wythes with the web disposed in the space between the wythes and extending through the slot of the tension anchor for tying said wythes together.

2. An adjustable wall tie as claimed in claim 1 in which the tension anchor and the double ended hook are formed of heavy wire stock metal.

3. An adjustable wall tie as claimed in claim 2 in which the base member is an elongated wire having a plurality of equispaced pairs of substantially parallel longitudinal side members extending perpendicular therefrom.

4. An adjustable wall tie as claimed in claim 3 in which an intermediate elongated wire parallel to and spaced from the elongated base wire is connected to the plurality of equipspaced pairs of substantially parallel longitudinal side members.

* * * * *